US007818976B2

(12) United States Patent
Nuiding

(10) Patent No.: US 7,818,976 B2
(45) Date of Patent: Oct. 26, 2010

(54) REFRIGERATION DEVICE

(75) Inventor: Wolfgang Nuiding, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 478 days.

(21) Appl. No.: 11/664,232

(22) PCT Filed: Sep. 28, 2005

(86) PCT No.: PCT/EP2005/054872

§ 371 (c)(1),
(2), (4) Date: Mar. 29, 2007

(87) PCT Pub. No.: WO2006/037745

PCT Pub. Date: Apr. 13, 2006

(65) Prior Publication Data

US 2008/0072617 A1 Mar. 27, 2008

(30) Foreign Application Priority Data

Oct. 5, 2004 (DE) ..... 10 2004 048 476

(51) Int. Cl.
*F25D 19/00* (2006.01)

(52) U.S. Cl. ..... 62/453; 62/452; 62/506

(58) Field of Classification Search ..... 62/452–455, 62/506

See application file for complete search history.

(56) References Cited

U.S. PATENT DOCUMENTS 1,769,119 A * 7/1930 Davenport ..... 62/89

FOREIGN PATENT DOCUMENTS

| | | |
|---|---|---|
| DE | 4432439 A1 | 3/1996 |
| FR | 2 650 377 | 2/1991 |
| JP | 58-13981 | 1/1983 |
| JP | 60-62583 | 4/1985 |
| JP | 8-240374 | 9/1996 |
| JP | 10-111067 | 4/1998 |

OTHER PUBLICATIONS

International Search Report PCT/EP2005/054872.

* cited by examiner

*Primary Examiner*—Melvin Jones
(74) *Attorney, Agent, or Firm*—James E. Howard; Andre Pallapies

(57) ABSTRACT

A refrigeration device comprising a body, which has lateral walls and a rear wall and a condenser that is mounted on the exterior of the rear wall of the body. Said condenser extends over at least one of the edge zones of the exterior, behind which there is a respective lateral wall, when viewed from the direction of the depth of the body and a central zone of the exterior, behind which the interior of the body lies when viewed from the depth direction, is not covered by the condenser.

12 Claims, 2 Drawing Sheets

REFRIGERATION DEVICE

This invention relates to a refrigeration device, in particular the body of such a refrigeration device.

BACKGROUND OF THE INVENTION

Normally a condenser, which pumps refrigerant under high pressure, is mounted on the exterior of the rear wall, so that it is condensed therein and heat released by the condensation is discharged into the surroundings of the refrigeration device. During operation the liquefier is therefore one of the warmest parts of the refrigeration device, and its close proximity to the rear wall of the body means that some of the heat discharged from it returns to the interior of the refrigeration device through the insulation layer of the rear wall.

To reduce the energy consumption of refrigeration devices considerable effort has been made in recent years to improve the quality of thermal insulation. Improved insulation can of course be achieved by increasing the thickness of the insulation layer, but with predetermined exterior dimensions of the refrigeration device body this results in losses of useful interior volume.

SUMMARY OF THE INVENTION

The object of the invention is to indicate a refrigeration device in which the energy consumption can be further reduced by simple means or in which, at a given energy consumption, a particularly favorable ratio of interior volume to exterior dimensions can be achieved.

The invention is based on the fact that as the quality of the insulation of the refrigeration device improves, the average thermal power to be emitted by the condenser decreases. Whilst refrigeration devices of prior art required a condenser extending over the entire surface of the rear wall, modern, well insulated devices are provided with a condenser which only covers part of the rear side of the body. On the rear side of the body there are regions which differ in terms of their coefficient of thermal conductivity: whilst in a central zone of the rear wall the shortest distance between the surrounding area and the interior runs perpendicular to the wall surface and its length is exactly equal to the wall thickness, there are also edge zones of the rear wall behind which can be found not the interior, but a lateral wall, viewed from the direction of the depth of the body. The shortest distance from these edge zones through the insulation layer to the interior does not therefore run perpendicular to the outer surface of the rear wall, and is longer than the thickness of the insulation layer. According to the invention a refrigeration device is therefore proposed in which the condenser does not extend over the entire rear wall of the body but rather extends over only part of its surface, and in doing so covers only the well insulated edge zones but leads a less well insulated central zone uncovered.

Although a condenser is conceivable which covers opposing edge zones of the rear wall and leaves free an intervening central zone, a condenser which extends over exactly one of the edge zones is preferred because of the simpler structure.

In the central zone not covered by the condenser the exterior of the rear wall is preferably designed so that it projects from it. Such a projection may result in an increase in the thickness of the insulation layer in the central zone, but a recess which increases the interior may also be formed on the interior of the rear wall opposite the projection.

The condenser is preferably received in a channel which extends throughout the height of the rear side, thereby promoting efficient ventilation of the condenser in a flue effect.

This channel may be open at the edge, particularly if the refrigeration device is a built-in device in which, when mounted, walls of a furniture recess delimit the channel. However, an elongated shell element may also be mounted on the rear wall to delimit the channel on sides facing away from the rear wall.

To increase the ventilation efficiency of the condenser a forced ventilation device may be provided which, together with a compressor, may suitably be accommodated in a base unit of the body.

In the latter case the shell element extends in one or a plurality of parts from the forced ventilation device to the condenser.

BRIEF DESCRIPTION OF THE DRAWINGS

Further features and advantages of the invention are evident from the following description of exemplary embodiments with reference to the attached figures, in which.

DETAILED DESCRIPTION OF THE EXEMPLARY EMBODIMENTS OF THE PRESENT INVENTION

Figure 1:
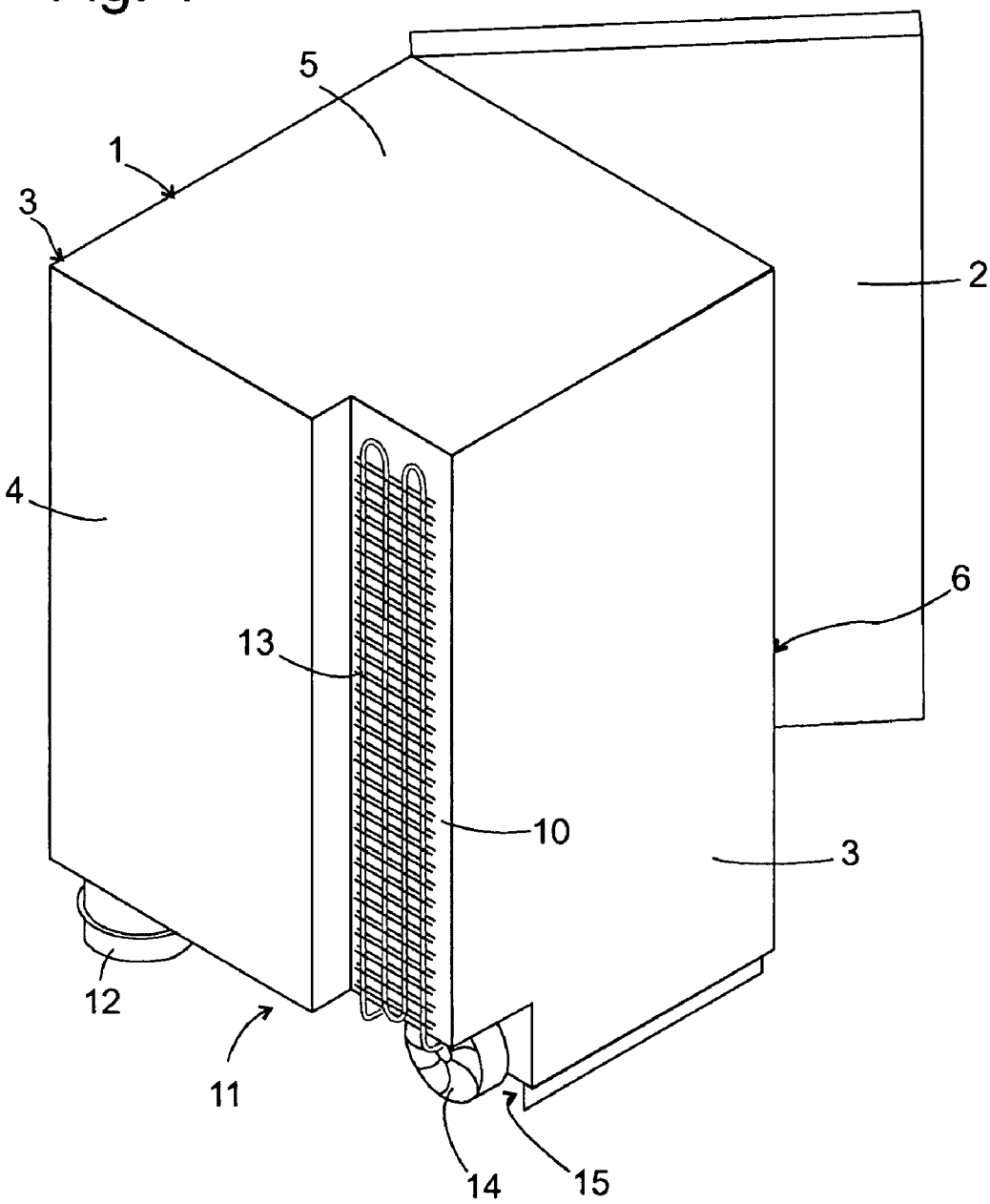
FIG. 1 shows a perspective view of a refrigeration device according to the invention, viewed obliquely from behind.

FIG. 1 shows a perspective view of a refrigeration device according to the invention with a body 1 and a door 2 which abuts onto body 1. Body 1 comprises lateral walls 3, a rear wall 4, ceiling 5 and a floor, all of which surround an interior 6 (FIG. 2) not visible in the figure. Walls 3, 4, ceiling 5 and the floor are formed in a manner of prior art by a common inner container 7, outer plates 8 and a layer 9 of solid insulating foam material enclosed between inner container 7 and outer plates 8. On the outside of rear wall 4 a channel 10 extends throughout the height of rear wall 4 from a recess 11, in which a condenser 12 is accommodated, to ceiling 5 of the body. A condenser 13 extends in the manner of a wire tube essentially throughout the height of channel 10. A fan 14 is mounted on the lower end of channel 10 in recess 11, causing outside air to be sucked through a channel 15 running between the floor of body 1 and a standing base on which the device is installed, then forced through channel 10 to cool condenser 13 therein.

Figure 2:
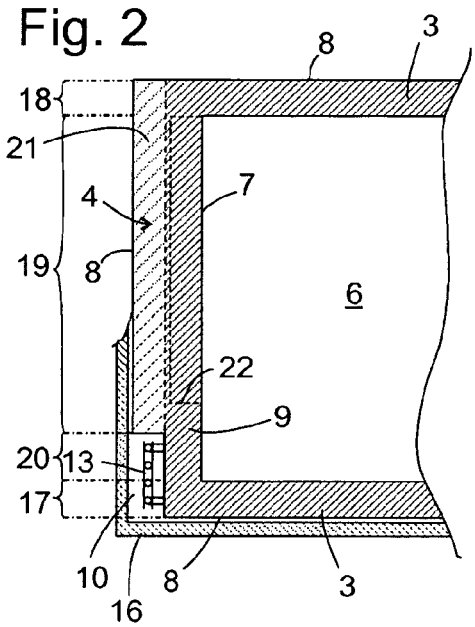
FIG. 2 shows a diagrammatic horizontal section through the refrigeration device in FIG. 1 and through part of the furniture recess in which the refrigeration device is mounted.

In the design shown in FIGS. 1 and 2 vertical channel 10 is delimited on two sides by rear wall 4, and is otherwise open at the edge. However, the flow of air generated by fan 14 is efficiently conducted through channel 10 when the device is installed in a furniture recess and its walls 16 delimit channel 10 around the remainder of the periphery.

As shown in FIG. 2 the rear side of refrigeration device body 1 can be divided into two edge zones 17 and a central 19, and possibly an intermediate zone 20, one of lateral walls 3 lying behind central zone 19 of interior 6 and behind each of edge zones 17, viewed in the depth direction, i.e. in the direction of an arrow P in FIG. 2. Due to the presence of lateral wall 3, the flow of heat into interior 6 per unit of area in edge zone 17 is much smaller than in the intermediate zone 20, in which condenser 13 overlaps interior 6, viewed in the depth direction. By using the small condenser 13 instead of a condenser extending over the entire rear wall 4, the possibility is provided of filling region 21, thereby released and represented faintly shaded in FIG. 2, with insulating material, thereby achieving much better insulation in this region of the rear wall without altering the exterior dimensions of the device. Alternatively insulation material can be saved according to the insulation material on the inside of the rear wall added in region 21, so that the thickness of rear wall 4 remains essentially unchanged and a recess 22, represented as a dotted outline, is formed on the inside of rear wall 4, which recess increases the volume of interior 6.

Figure 3:
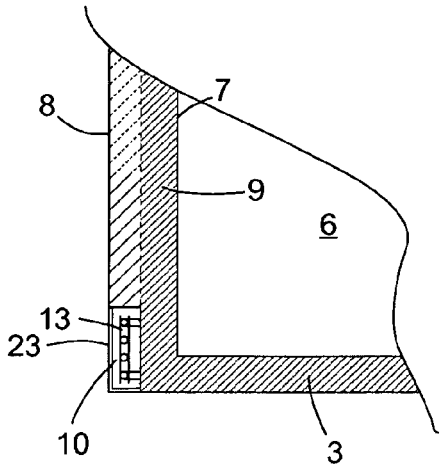
FIG. 3 shows a horizontal section, similar to that in FIG. 2, through a second design of the refrigeration device.

FIG. 3 shows a partial horizontal section through a second design of a body 1 according to the invention. It differs from the design shown in FIGS. 1 and 2 in that channel 10, extending throughout the height of rear wall 4, is delimited on two sides by a shell element 23 of sheet steel or plastic, which is fastened to rear wall 4 so that channel 10 is closed level with condenser 13 throughout its periphery.

Figure 4:
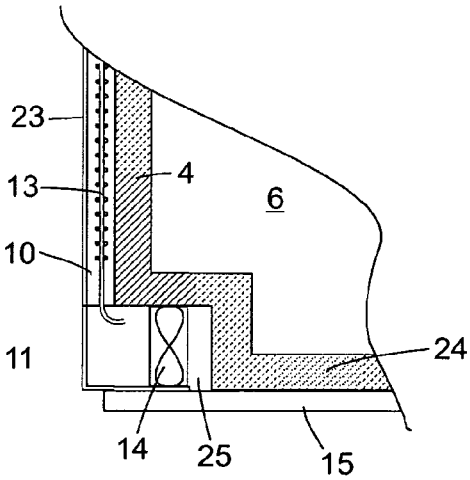
FIG. 4 shows a vertical partial section through the refrigeration device according to the second design.

FIG. 4 shows a vertical partial section through the rear lower region of the same body 1 as in FIG. 3. Here it is seen that shell element 23 is extended beyond the lower end of channel 10 as far as fan 14 mounted in recess 11 to form a closed pipe which conducts an air flow generated by fan 14 fully through channel 10. Fresh air is fed to fan 14 through a channel 15 below floor 24 of body 1 and through a gap 25 between floor 24 and shell element 23.

The invention claimed is:

1. A refrigeration device comprising:

a body including lateral walls and a rear wall having an outside surface with edge zones and a central zone, the edge zones overlapping the lateral walls extended such that each lateral wall is positioned behind one of the edge zones when viewed in a direction from the rear wall of the body, and the central zone disposed between the edge zones such that an interior portion of the body is positioned behind the central zone when viewed in a direction from the rear wall of the body; and a condenser mounted on the outside surface of the rear wall and extending over at least one of the edge zones of the outside surface, and wherein the central zone of the outside surface is not covered by the condenser, and wherein a coiled portion of the condenser extends along a channel throughout a height dimension of the channel.

2. The refrigeration device according to claim 1, wherein the condenser extends over only one of the edge zones.

3. The refrigeration device according to claim 1, wherein the outside surface of the rear wall in the central zone projects outwardly from the body in a rearwardly direction.

4. The refrigeration device according to claim 3, wherein the condenser is received in the channel extending along the rear side throughout a height dimension of the body.

5. The refrigeration device according to claim 4, wherein the channel is open along an edge.

6. A refrigeration device comprising:

a body including lateral walls and a rear wall having an outside surface with edge zones and a central zone, the edge zones overlapping the lateral walls extended such that each lateral wall is positioned behind one of the edge zones when viewed in a direction from the rear wall of the body, and the central zone disposed between the edge zones such that an interior portion of the of the body is positioned behind the central zone when viewed in a direction from the rear wall of the body; and a condenser mounted on the outside surface of the rear wall and extending over at least one of the edge zones of the outside surface, and wherein the central zone of the outside surface is not covered by the condenser, wherein the outside surface of the rear wall in the central zone projects outwardly from the body in a rearwardly direction, wherein the condenser is received in a channel extending along the rear side throughout a height dimension of the body, and wherein the channel is delimited by the rear wall with the condenser and by an elongated shell element mounted on the rear wall.

7. The refrigeration device according to claim 6, further comprising a forced ventilation device assigned to the condenser and providing airflow through the channel.

8. The refrigeration device according to claim 7, wherein the forced ventilating device is mounted on a base region of the body.

9. The refrigeration device according to claim 7, wherein the shell element extends from the forced ventilating device to the condenser.

10. The refrigeration device according to claim 1, wherein the condenser is a planar wire tube condenser extending in a plane parallel to the outside surface of the central zone of the rear wall of the body.

11. The refrigeration device according to claim 4, further comprising:

a forced ventilation device assigned to the condenser and providing airflow through the channel; and a second channel between a floor of the body and a standing base on which the refrigeration device is installed, wherein the second channel is in fluid communication with the forced ventilating device.

12. The refrigeration device according to claim 7, comprising a second channel between a floor of the body and a standing base on which the refrigeration device is installed, the second channel in fluid communication with the forced ventilating device.

* * * * *